US006400074B1

(12) United States Patent
Yamaura et al.

(10) Patent No.: US 6,400,074 B1
(45) Date of Patent: Jun. 4, 2002

(54) VACUUM CONTAINER FOR FIELD EMISSION CATHODE DEVICE

(75) Inventors: Tatsuo Yamaura; Shigeo Itoh; Gentaro Tanaka, all of Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/346,978

(22) Filed: Jul. 2, 1999

(30) Foreign Application Priority Data

Jul. 9, 1998 (JP) ..... 10-194767

(51) Int. Cl.[7] ..... H01J 7/18

(52) U.S. Cl. ..... 313/495; 313/309; 313/549; 313/560

(58) Field of Search ..... 313/495, 582, 313/493, 584; 445/25, 40, 41, 42

(56) References Cited

U.S. PATENT DOCUMENTS 5,763,998 A * 6/1998 Colombo et al. ..... 313/495
6,118,213 A * 9/2000 Ilcisin et al. ..... 313/582
6,236,159 B1 * 6/2001 Inoue et al. ..... 313/582

* cited by examiner

*Primary Examiner*—Vip Patel
*Assistant Examiner*—Ken A Berck
(74) *Attorney, Agent, or Firm*—Oblon, Spivak, McClelland, Maier & Neustadt, P.C.

(57) ABSTRACT

A vacuum container for a field emission cathode device capable of attaining manufacturing of the field emission cathode device with increased efficiency and enhancing durability thereof. The vacuum container includes a cathode-side substrate on which field emission cathodes are formed and an anode-side substrate arranged so as to be spaced from each other at a predetermined distance in a direction in which electrons are emitted, resulting in a space being defined therebetween. A gas or hydrogen emission material is arranged at at least one position including a position which is defined in said space or an additional space contiguous to said space and is farthest from said evacuation section.

8 Claims, 8 Drawing Sheets

VACUUM CONTAINER FOR FIELD EMISSION CATHODE DEVICE

BACKGROUND OF THE INVENTION

This invention relates to a vacuum container for a field emission cathode device, and more particularly to a vacuum container in which field emission elements or field emission cathodes acting as an electron source are received.

It has been recently attempted to receive a number of micro-sized field emission cathodes in a vacuum container made of glass or the like to put a field emission electronic equipment in which vacuum microstructures of a size as small as microns are integrated into practice in the form of vacuum microelectronics.

Such vacuum microelectronics are directed to development of applied field emission devices such as a field emission display device of a thin flat panel structure, an image pickup device, an electron beam device for lithography or the like.

A thin flat panel display device in which field emission cathodes are incorporated is so constructed that a plurality of micro-sized or fine cold electrodes (emitters) are arranged for each of picture cells.

The fine cold electrodes proposed each are constituted by a field emission cathode having a distal end formed into an acute angle, a field emission cathode of the MIM type, an electron emission element of the surface conductive type, an electron emission element of the PN junction type or the like.

The most typical one of such devices is a field emission display (FED) having field emission cathodes incorporated therein, as disclosed in Nikkei Electronics, No. 654 Jan. 29, 1996), pp 89–98. A typical one of the field emission cathodes is a field emission cathode called the Spindt type.

Now, such a field emission cathode of the Spindt type will be described with reference to FIG. 10. More particularly, the field emission cathode includes a cathode substrate K having a number of emitter electrodes arranged thereon. $SiO_2$ designates an insulating layer formed all over the cathode substrate K. The insulating layer is provided thereon with a gate electrode GT in the form of a film by deposition or the like. The gate electrode GT is formed with holes, through which a distal end of the emitter electrodes E is exposed, so that electrons emitted from the emitter electrodes E may be outwardly discharged.

In the field emission cathode of the Spindt type thus constructed, application of a voltage Vgk between the cathode electrode K and the gate electrode GT permits electrons to be emitted from the distal end of the emitter electrodes E. The electrons thus emitted are captured by an anode voltage Va applied to an anode electrode A arranged opposite to the cathode electrode K through a vacuum space. A plurality of such field emission cathodes are arranged in each of groups and a plurality of such gate electrodes arranged in a stripe-like manner are scanned in order, during which plural such stripe-like cathode electrodes are fed with an image signal. This results in phosphors arranged on the anode electrode emitting light, so that the field emission cathodes may function for a display device.

Now, an envelope for such a display device will be described with reference to FIGS. 11(*a*) and 11(*b*), which are a perspective view of the envelope and a side elevation view in section thereof, respectively.

In FIGS. 11(*a*) and 11(*b*), reference numeral 1 designates a glass substrate arranged on a side of an anode (hereinafter also referred to as "anode-side substrate") and 2 is a glass substrate on a side of a cathode (hereinafter also referred to as "cathode-side substrate"). The anode-side substrates 1 and cathode-side substrate 2 are arranged opposite to each other so as to define a space therebetween, in which field emission cathodes of a size as small as microns and anode electrodes are received while being arranged on an inner surface of the cathode-side substrate and an inner surface of the anode-side substrate in a manner to be opposite to each other, respectively.

Reference numeral 3 designates a getter substrate, which is formed on a bottom surface thereof with an evacuation hole 6*a* through which the envelope is evacuated at a high vacuum. 4 is a getter member generally made of a getter material of the evaporation type. Thus, the getter member is flashed at an elevated temperature to maintain a gas pressure in the envelope at a low level, after the envelope is evacuated at a high vacuum.

The cathode-side substrate 2 and anode-side substrate 1 are sealedly joined to each other while being kept spaced from each other at a microinterval as fine as from about 250 $\mu$m to millimeters. Also, both substrates 1 and 2 are arranged while being kept deviated from each other. Such arrangement permits a cathode electrode lead-out section of the field emission cathode and a gate electrode lead-out section thereof to be arranged in regions of the substrates which are kept from being opposite to each other.

Also, if color display is desired, the anode-side substrate 1 may be formed so as to have a projected region, resulting in an anode lead-out section (not shown) being arranged in the projected region.

The cathode-side substrate 2 and anode-side substrate 1 are sealedly joined at a peripheral portion thereof other than the getter substrate 3 to each other by means of frit glass 5 or the like. The getter substrate 3 is set in an evacuation unit (not shown), so that gas therein is discharged through a vacuum pump.

Thus, in the vacuum envelope in which the field emission cathodes are arranged, the cathode-side substrate 2 and anode-side substrate 1 are kept spaced from each other at a microdistance, to thereby define the space therebetween. In order to keep the space at a high vacuum, the getter 4 is generally placed in a getter chamber. Then, the getter 4 is externally heated to an elevated temperature, to thereby be evaporated, so that a getter mirror may be formed all over a surface of the getter chamber. The getter mirror serves to adsorb thereon any residual gas in the envelope after evacuation of the envelope. The residual gases include gas entering the envelope and that generated from a material for the electrodes or the like.

The space defined in such a flat-type display device in the form of a vacuum container is formed into a highly small height or dimension. Such a small height of the space causes a deterioration in passage or migration of gas in the space when the space is evacuated at a high vacuum, resulting in formation of a vacuum atmosphere in the space being highly difficult or substantially impossible. A failure in satisfactory evacuation of the space or envelope causes a deterioration in emission of the field emission cathodes due to the residual gas.

Also, the amount of material for the field emission cathodes and the like present in the space of the envelope is increased relatively to the volume of the space, resulting in a length of time required for evacuating the residual gas present in the material or absorbed on a surface thereof to form a vacuum at a predetermined level or more in the envelope being highly increased, so that the evacuation operation is deteriorated in efficiency.

SUMMARY OF THE INVENTION

The present invention has been made in view of the foregoing disadvantage of the prior art.

Accordingly, it is an object of the present- invention to provide a vacuum container for a field emission cathode device which is capable of efficiently attaining evacuation of the vacuum container.

It is another object of the present invention to provide a vacuum container for a field emission cathode device which is capable of permitting an increase in durability of-the field emission cathode device.

In accordance with the present invention, a vacuum container for a field emission cathode device is provided. The vacuum container includes a first substrate made of glass, a second substrate made of glass and arranged so as to be opposite to the first substrate, a side wall arranged between the first substrate and the second substrate to space the first and second substrates from each other, to thereby form a space therebetween, an evacuation section formed with an evacuation hole through which the space is evacuated at a high vacuum and sealed after evacuation, to thereby keep the space at a vacuum, and a gas emission material arranged at at least one position including a position which is defined in the space or an additional space contiguous to the space and is-farthest from the evacuation section.

In a preferred embodiment of the present invention, the first substrate is formed thereon with field emission cathodes and the second substrate is provided thereon with anodes, which are arranged in a manner to be opposite to the field emission cathodes.

In a preferred embodiment of the present invention, the gas emission material is hydrogenated alloy or a hydrogen occlusion material containing at least one selected from the group consisting of Zn, Ti, Ta, V, Mg and Th.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 3(*b*) is a perspective view showing a hydrogen emission material arranged in a holder;

FIG. 11(*b*) is a side elevation view in section of the vacuum envelope shown in FIG. 11(*a*).

DETAILED DESCRIPTION OF THE PREFERRED EMBODIMENT

Now, a vacuum container for a field emission cathode device according to the present invention will be described hereinafter with reference to the accompanying drawings.

Figure 1A:
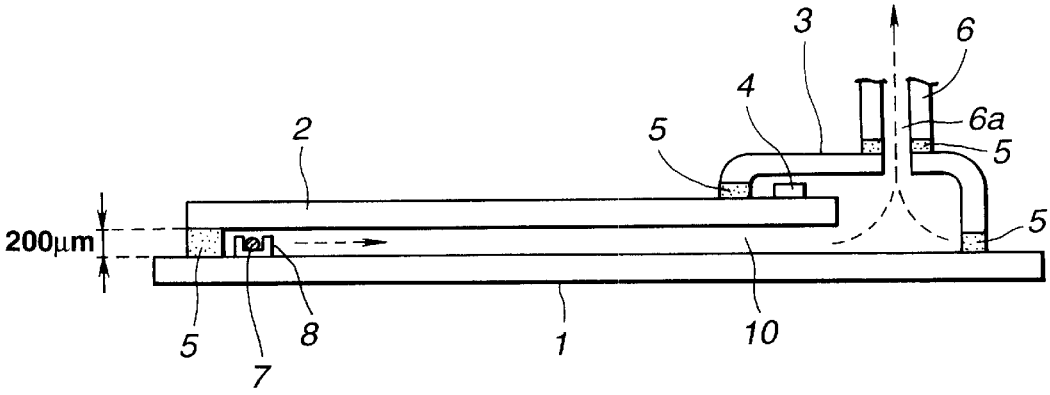
FIGS. 1(*a*) and 1(*b*) each are a schematic view showing an embodiment of a vacuum container for a field emission cathode device according to the present invention.
Figure 1B:
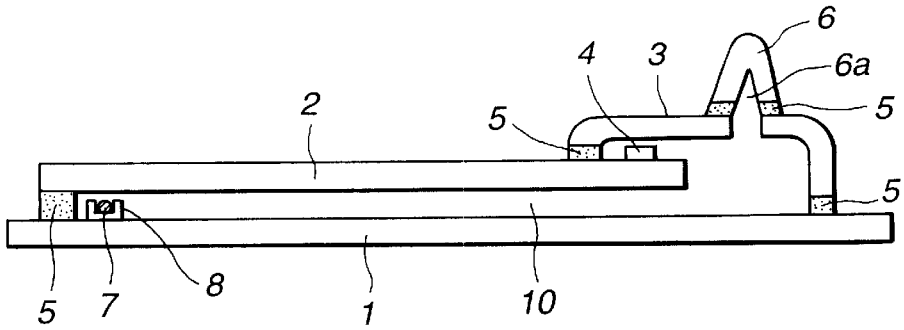
Figure 10:
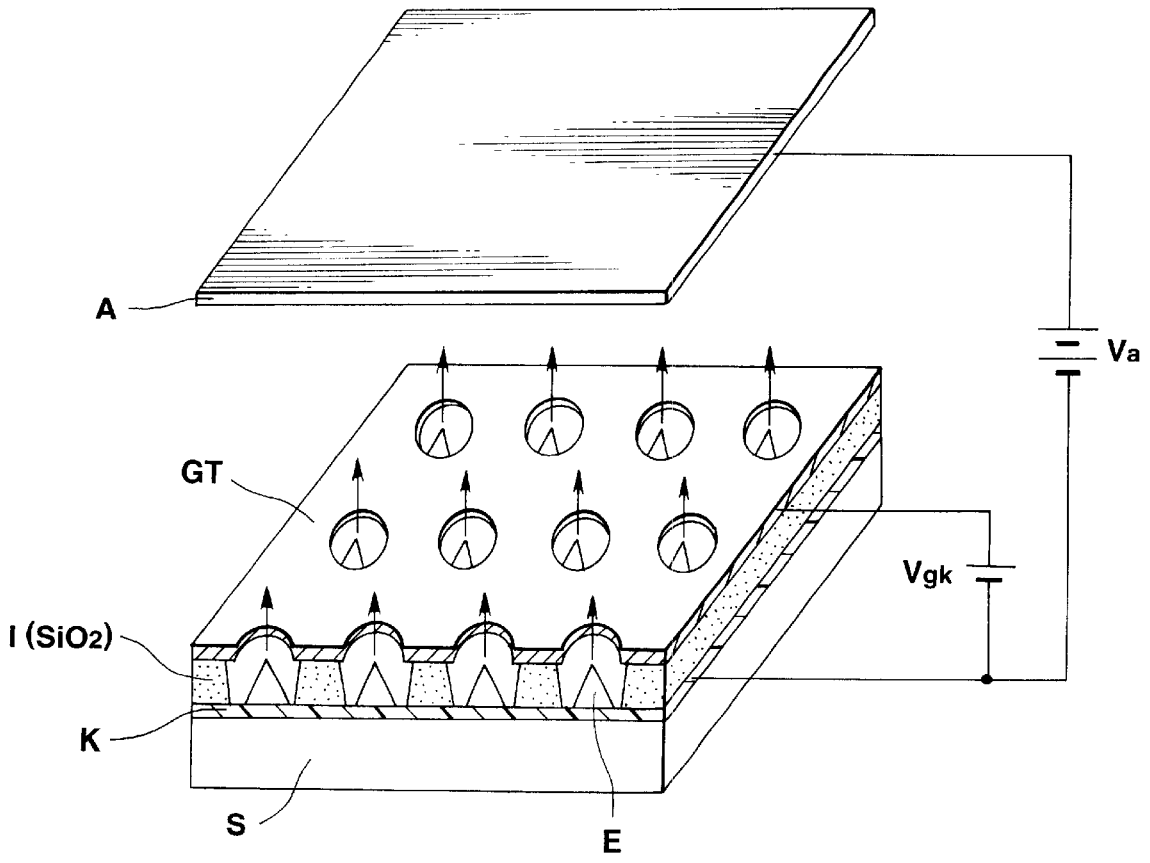
FIG. 10 is a schematic view showing a field emission cathode.
Figure 11A:
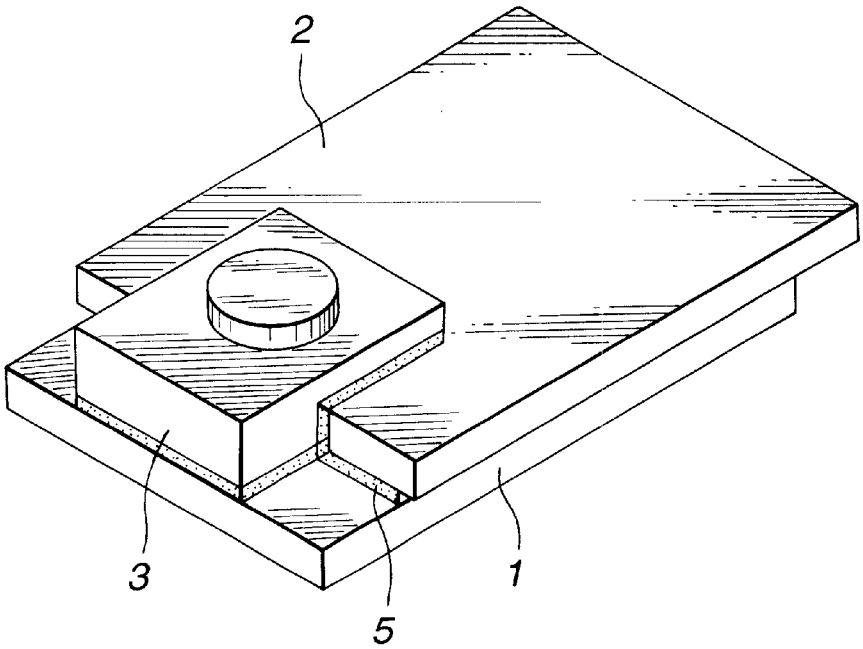
FIG. 11(*a*) is a perspective view showing a conventional vacuum envelope.
Figure 11B:
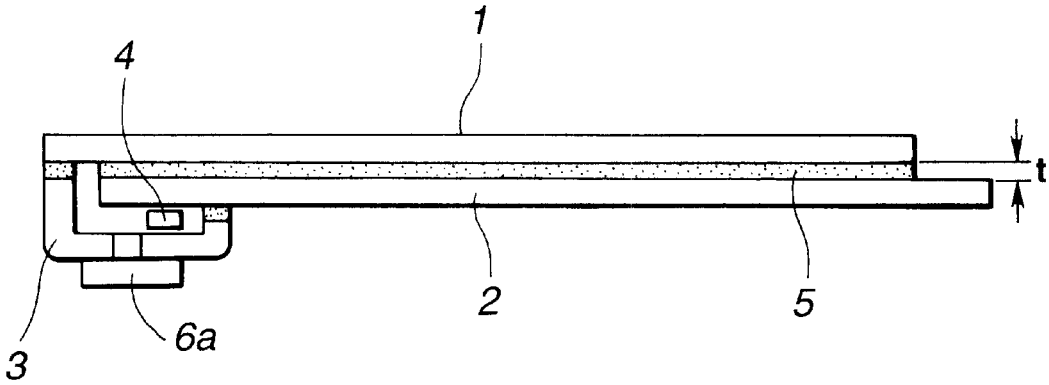

Referring first to FIGS. 1(*a*) to 3(*b*), an embodiment of a vacuum container according to the present invention is illustrated. A vacuum container of the illustrated embodiment includes an anode-side substrate 1 and a cathode-side substrate 2, which are provided thereon with anodes and cathodes constructed in substantially the same manner as the anodes A and cathodes K in the prior art described above with reference to FIG. 10. The anode-side substrate 1 and cathode-side substrate 2 have a seal glass paste 5 applied to a periphery thereof, which is calcined to sealedly join the substrates 1 and 2 to each other while defining a gap or space 10 therebetween, resulting in the vacuum container of the illustrated embodiment being provided.

The anode-side substrate 1 and cathode-side substrate 2 are fixedly joined together while keeping the gap 10 at, for example, 200 $\mu$m by means of a spacer (not shown). During formation of the vacuum container, a getter substrate 3 and an evacuation tube 6 are concurrently fixed onto the vacuum container as shown in FIGS. 1(*a*) and 1(*b*). Also, the getter substrate 3 provides a getter chamber, which is provided therein with a getter 4 of, for example, Ba.

Figure 2:
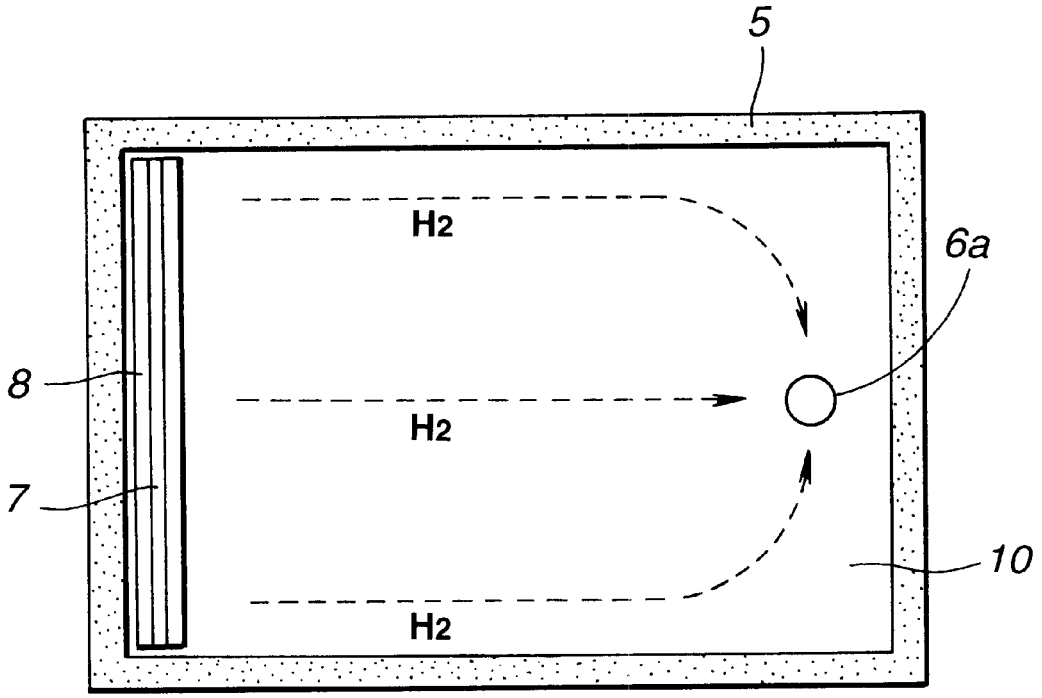
FIG. 2 is a schematic view showing a hydrogen emission material incorporated in the vacuum container shown in FIGS. 1(*a*) and 1(*b*)

Further, the space 10 of the vacuum container is provided at an inner position thereof farthest from the evacuation pipe 6 or an evacuation hole 6*a* in the evacuation pipe 6 with a hydrogen emission material 7 while being held in a holder 8. As will be noted from FIG. 2, the hydrogen emission material 7 is arranged in the space 10 so as to extend along an end of the container opposite to an end thereof in proximity to the evacuation hole 6*a* while being held in the holder 8.

Figure 3A:
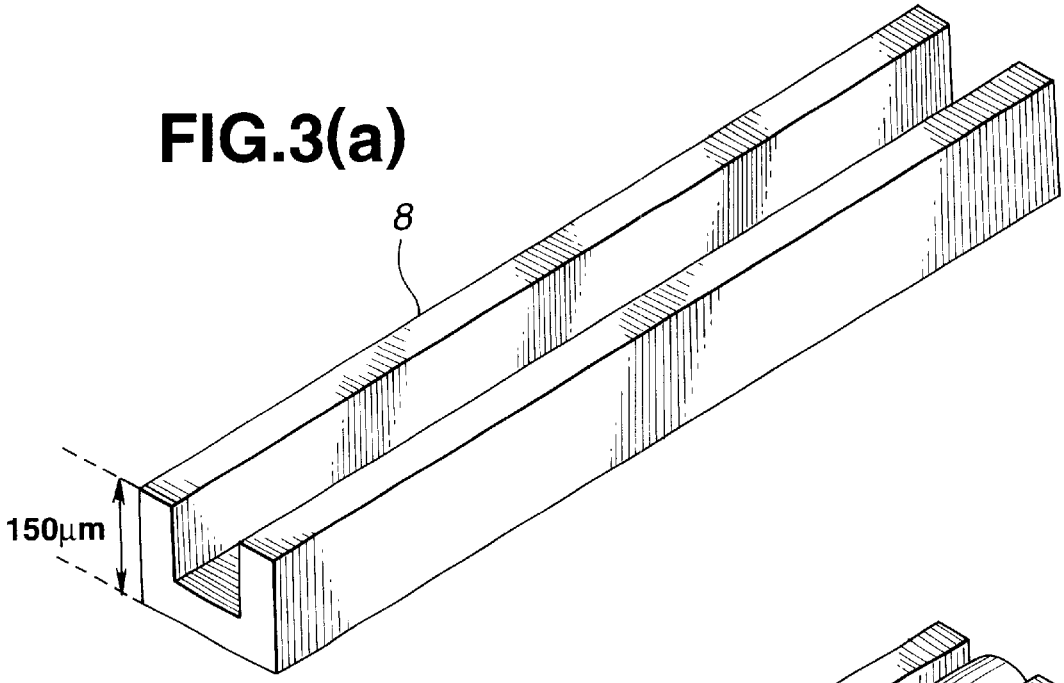
FIG. 3(*a*) is a perspective view showing a holder for a hydrogen emission material.
Figure 3B:
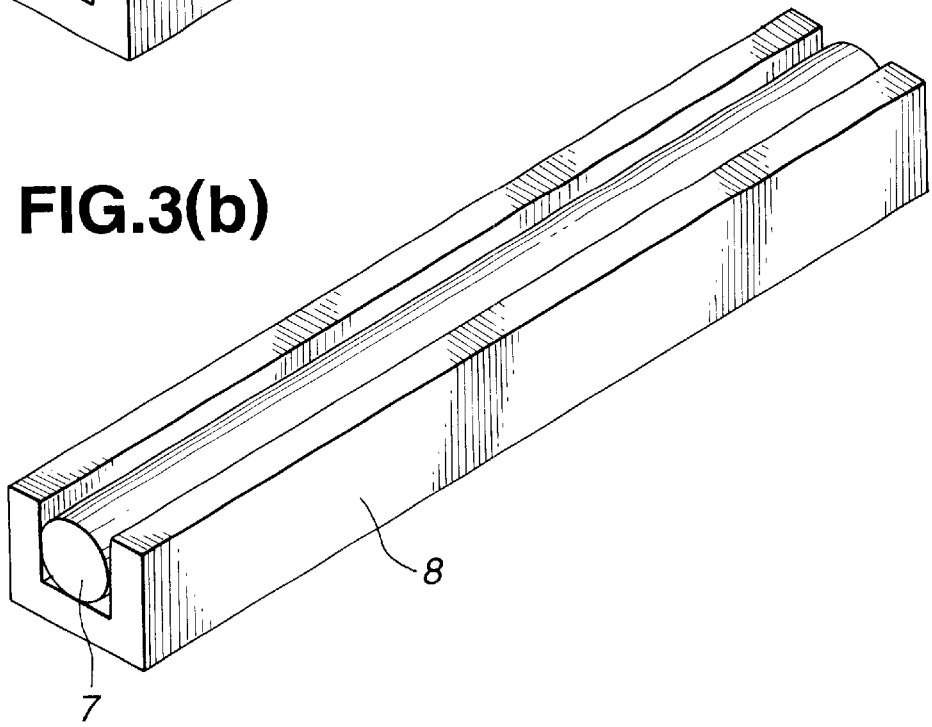

The holder 8, as shown in FIGS. 3(*a*) and 3(*b*), is made of glass and formed into a height of about 150 $\mu$m. Also, the holder 8 is provided with a groove in a manner to extend in a longitudinal direction thereof, in which the hydrogen emission material 7 is fittedly arranged. The hydrogen emission material 7 is formed of a wire of about 100 $\mu$m in diameter made by, for example, sintering of $ZrH_2$. The holder 8 may be provided on a side wall thereof with openings which facilitate discharge of gas.

The holder 8 which has the hydrogen emission material 7 thus held therein is positioned at a region in the space 10 away from the evacuation tube 6 as shown in FIGS. 1(*a*) and 2 and then the anode-side substrate 1 and cathode-side substrate 2 are joined together as described above.

The vacuum container formed as shown in FIG. 1(*a*) is then subject to a treatment at an elevated temperature. The treatment causes gas to be removed from a material for the electrodes and the like, which is discharged from the vacuum container through the evacuation tube 6 by means of a vacuum pump (not shown), resulting in a high vacuum atmosphere being formed in the space 10.

For this purpose, gas is outwardly discharged from the evacuation hole 6*a* as indicated at broken lines in FIG. 1(*a*). Concurrently, hydrogen is emitted from the hydrogen emission material 7 and directed toward the evacuation hole 6*a* as shown in FIGS. 1(*a*) and 2. The hydrogen permits gas remaining in the space 10 to be forced into the evacuation hole 6*a*, so that the residual gas which is a so-called impurity may be satisfactorily discharged from the space 10 in spite of the fact that the space 10 is reduced in conductance.

The hydrogen emitted from the hydrogen emission material 7 is discharged from the space 10 subsequently to the impurity gas.

After the evacuation is fully attained, the evacuation tube 6 is sealed as shown in FIG. 1(*b*), so that a vacuum in the space 10 may be kept at a predetermined level or more. Then, a getter flash treatment or the like is carried out to permit any gas possibly remaining in the space to be adsorbed on the getter, so that the vacuum container may be increased in vacuum.

Emission of hydrogen from the hydrogen emission material 7 continues to a degree even after the evacuation tube 6 is sealed. Also, a part of hydrogen emitted from the hydrogen emission material 7 during evacuation of the residual gas possibly remains in the space 10 without being discharged therefrom.

However, the hydrogen remaining in the space 10 is kept from adversely affecting the cathodes to deteriorate emission characteristics of the cathodes. Rather, the hydrogen functions to prevent oxidation and contamination of the emitters. Thus, remaining of the hydrogen in the space contributes to an increase in durability of the field emission cathode device.

Also, the illustrated embodiment is so constructed that the hydrogen emission material 7 is arranged in only a part of the space 10 rather than in the form of a thin film all over the space 10. Such arrangement of the hydrogen emission material 7 eliminates excessive emission of hydrogen from the material 7, to thereby prevent the remaining hydrogen from adversely affecting the device. Such a reduction function of the $H_2$ gas during the evacuation as described above extends over the field emission cathode device, because the hydrogen emission material 7 is arranged at only a position in the space 10 farthest from the evacuation hole 6*a*.

In addition, the hydrogen emission material 7 also acts as a getter for reducing other gas such as, for example, oxygen after the evacuation, resulting in preventing oxidation of the emitter electrodes, leading to an increase in durability of the field emission cathode device.

In the illustrated embodiment, the hydrogen emission material 7 is made of a wire obtained by sintering of $ZrH_2$. Also, it may be made by mixing a $ZrH_2$ powder with water glass to prepare a paste and filling the groove of the holder 8 with the paste, followed by drying of the paste. Alternatively, it may be constituted by an a-Si:H film, a-Si:H particles or the like deposited on a glass plate or glass rod.

Arrangement of the hydrogen emission material 7 may be carried out in various manners as shown in FIGS. 4 to 9.

Figure 4:
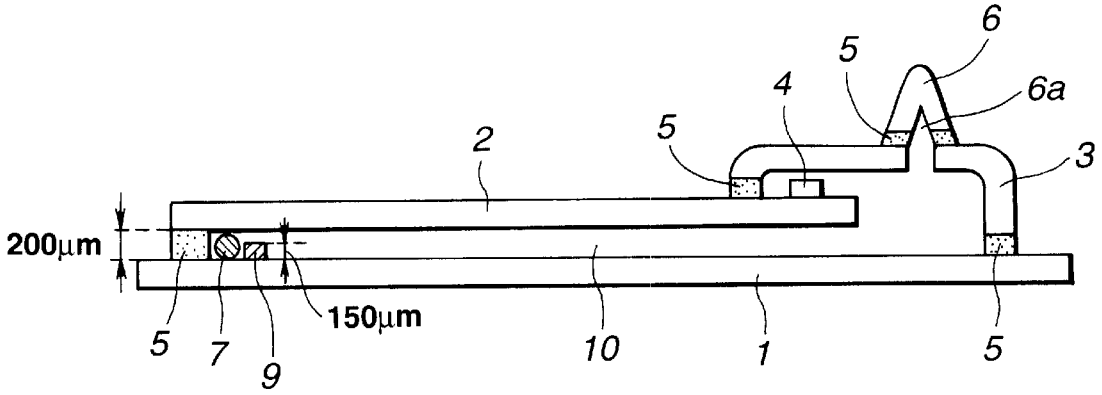
FIG. 4 is a schematic view showing another manner of arrangement of a hydrogen emission material.

More particularly, in FIG. 4, the hydrogen emission material 7 is fixedly arranged by means of a frame member 9. For this purpose, the frame member 9 which is formed into a height of, for example, 100 to 150 $\mu$m is arranged at the end of the space 10 farthest from the evacuation hole 6*a*, so that the hydrogen emission material 7 is arranged between the frame member 9 and the side wall of the space 10.

Figure 5:
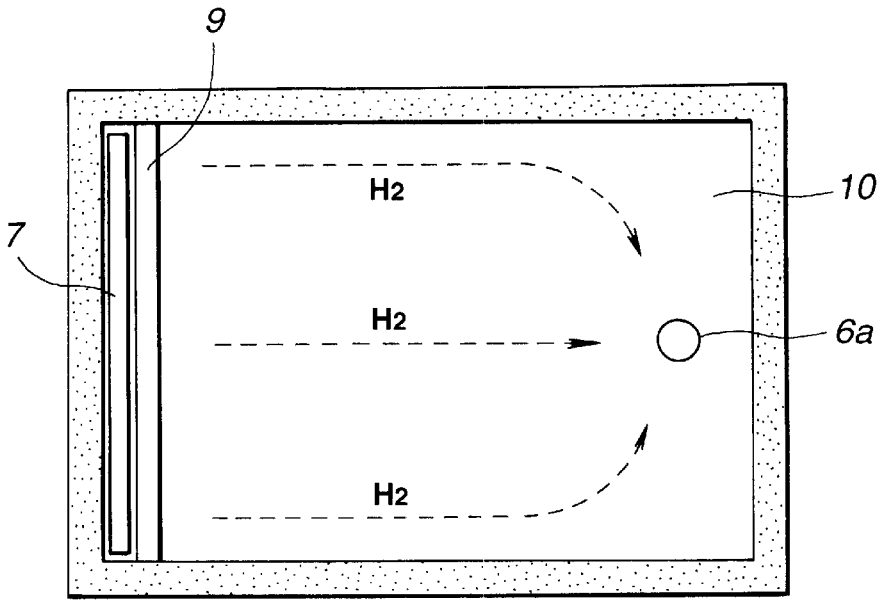
FIG. 5 is a schematic view showing arrangement of a hydrogen emission material.
Figure 6:
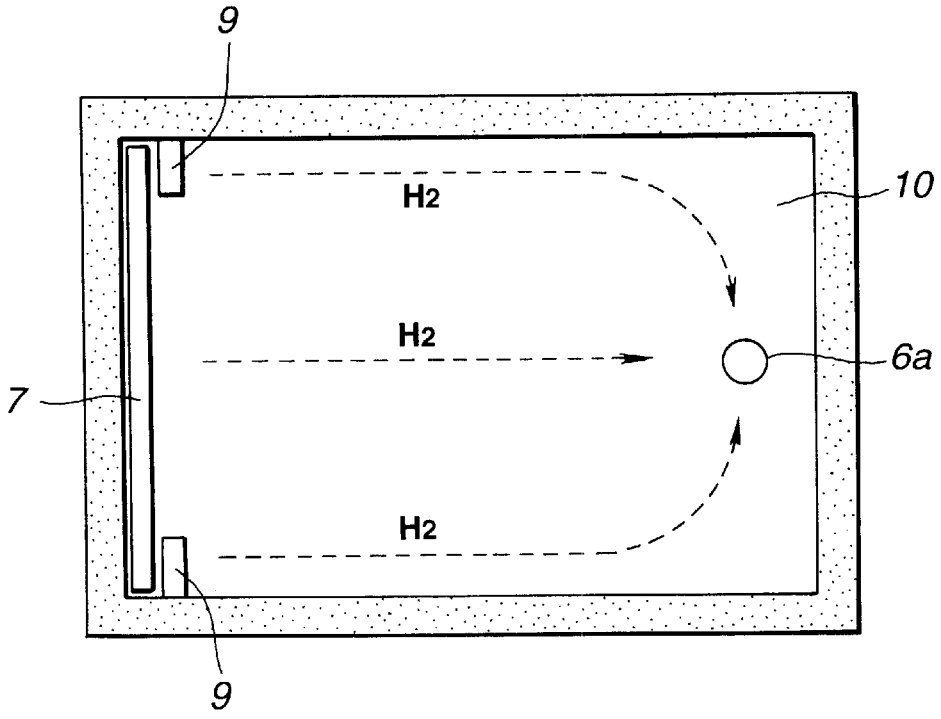
FIG. 6 is a schematic view showing arrangement of a hydrogen emission material.

In this instance, the frame member 9 may be formed into a rectangular parallelopiped shape of substantially the same size as the hydrogen emission material as shown in FIG. 5. Alternatively, it may be constructed so as to regulate both ends of the hydrogen emission material 7.

Figure 7:
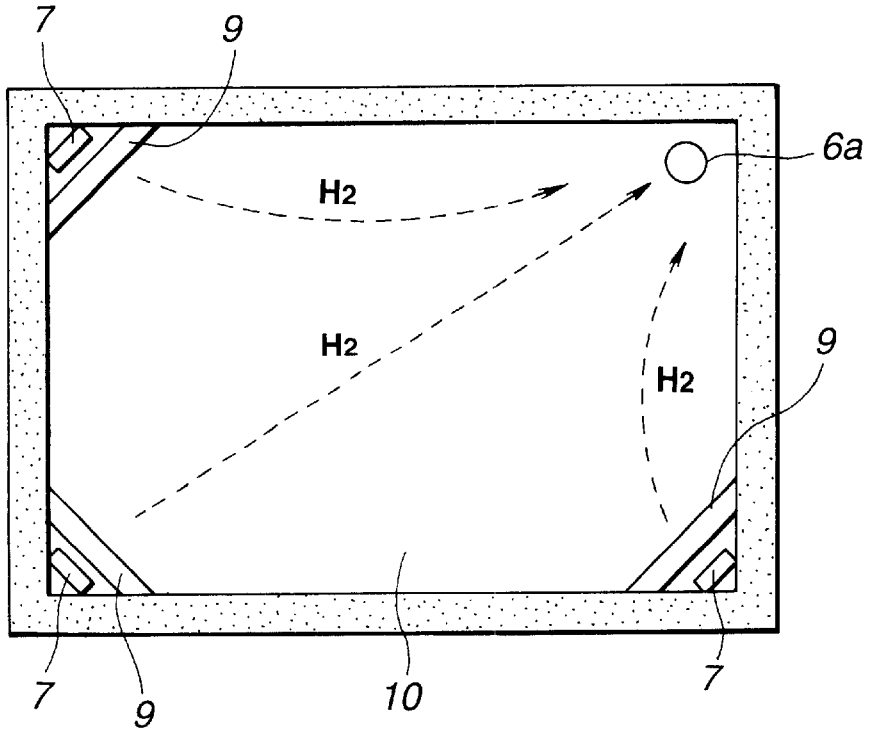
FIG. 7 is a schematic view showing arrangement of a hydrogen emission material.

In FIG. 7, the evacuation hole 6*a* is arranged at one of corners in the space 10. The hydrogen emission material 7 is arranged at each of the remaining three corners. Such arrangement significantly enhances a reduction function of $H_2$ gas. For this purpose, the frame member 9 is arranged at each of the three corners other than the corner at which the evacuation hole 6*a* is arranged, so that the hydrogen emission material 7 is arranged between each of the frame members 9 and each of the corners.

Figure 8:
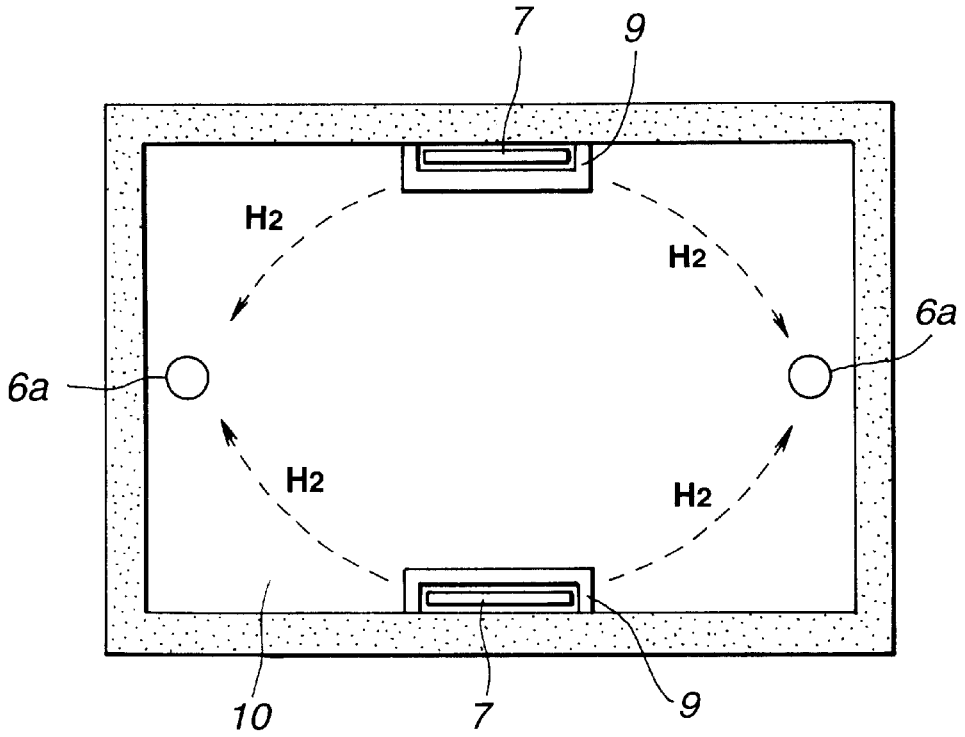
FIG. 8 is a schematic view showing arrangement of a hydrogen emission material.

In FIG. 8, two such evacuation holes 6*a* are arranged on lateral walls of the space 10 so as to be spaced from each other in a longitudinal direction of the space 10. Also, the frame member 9 which is formed into a U-shape is positioned at a central portion of each of upper and lower walls of the space 10 which is farthest from the evacuation holes 6*a*. The hydrogen emission material 7 is arranged between each of the frame members 7 and the wall of the space 10. Such arrangement permits a reduction function of the hydrogen emission materials 8 to extend all over the whole inner surface of the device during the evacuation through the evacuation holes 6*a*.

The arrangement shown in each of FIGS. 7 and 8 may be suitably applied to the case that the hydrogen emission material 7 is held in the holder 8.

Figure 9:
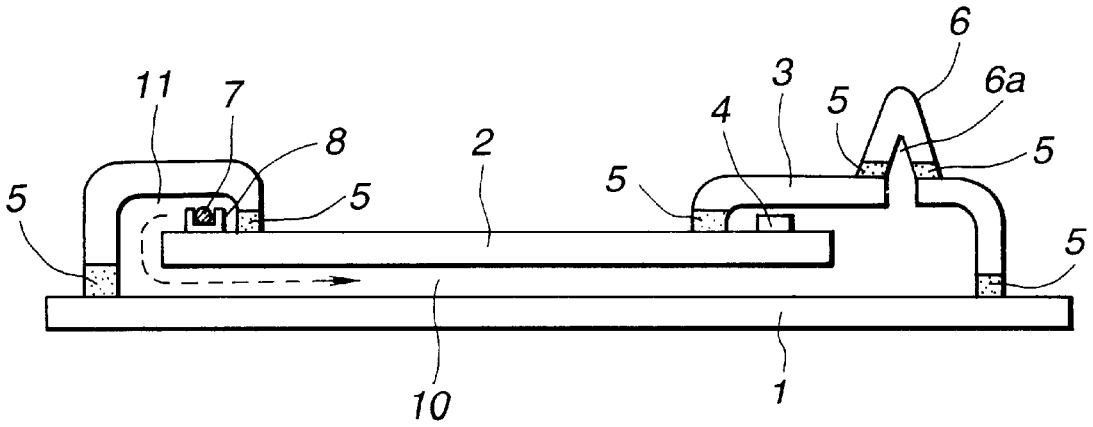
FIG. 9 is a schematic view showing arrangement of a hydrogen emission material.

In FIG. 9, an additional space 11 which is contiguous to the space 10 is formed at a position farthest from the evacuation hole 6*a* and has the hydrogen emission material 7 arranged therein while being held in the holder 8.

Such arrangement not only permits the hydrogen emission material 7 to satisfactorily exhibit a function of forcing put any impurity gas, but reduces a dead space in a display area (anode substrate) because the hydrogen emission material 7 is not received in the space 10. Further, the space 11 may function as a getter chamber after the sealing.

Furthermore, the present invention may be modified in various ways. Also, in the illustrated embodiment, the hydrogen emission material 7 is made of $ZrH_2$ by way of example. Alternatively, it may be made of hydrogenated alloy or a hydrogen occlusion material such as $TiH_2$, $TaH_2$, $VH_2$, $MgH_2$, $ThH_2$ or the like.

As can be seen form the foregoing, the vacuum container of the present invention is so constructed that gas or hydrogen emitted from the gas emission material arranged at the position farthest from the exhaust section in the space forces out any gas remaining in the space toward the evacuation section during the evacuation. Such construction permits the evacuation to be carried out with highly increased efficiency and for a short period of time.

Also, gas emitted from the gas emission material would remain in the space after the evacuation or sealing. However, the gas remaining in the space is hydrogen, so that it is kept from adversely affecting the cathodes, to thereby prevent a deterioration in emission characteristics of the cathodes. Rather, it prevents oxidation of the emitters, to thereby contribute to an increase in durability of the field emission cathode device.

Further, the gas emission material acts as a getter after the sealing of the vacuum container, to thereby further contribute to an increase in durability of the device.

Thus, it will be noted that the present invention attains manufacturing of the vacuum container for the field emission cathode device with increased efficiency and improves operational reliability of the device.

While a preferred embodiment of the invention has been described with a certain degree of particularity with reference to the drawings, obvious modifications and variation are possible in light of. The above teachings. It is therefore to be understood that within the scope of the appended claims, the invention may be practiced otherwise than as specifically described.

What is claimed is:

1. A vacuum container for a field emission cathode device, comprising:

a first substrate made of glass;

a second substrate made of glass and arranged so as to be opposite to said first substrate;

a side wall arranged between said first substrate and said second substrate to space said first and second substrates from each other, to thereby form a space therebetween;

an evacuation section formed with an evacuation hole through which said space is evacuated at a high vacuum and sealed after evacuation, to thereby keep said space at a vacuum; and a hydrogen emission material arranged in at least one position including a position which is defined in said space or an additional space contiguous to said space and is farthest from said evacuation section.

2. A vacuum container as defined in claim 1, wherein said first substrate is formed thereon with field emission cathodes and said second substrate is provided thereon with anodes;

said anodes being arranged in a manner to be opposite to said field emission cathodes.

3. A vacuum container as defined in claim 1, wherein said hydrogen emission material is hydrogenated alloy or a hydrogen occlusion material containing at least one selected from the group consisting of Zr, Ti, Ta, V, Mg and Th.

4. A vacuum container as defined in claim 1, wherein said hydrogen emission material is held in a holder.

5. A vacuum container as defined in claim 4, wherein said holder is provided with a groove in which said hydrogen emission material is arranged.

6. A vacuum container as defined in claim 3, wherein said hydrogen emission material is formed of a wire made of sintered $ZrH_2$.

7. A vacuum container as defined in claim 1, wherein said hydrogen emission material is made of a Si:H.

8. A vacuum container as defined in claim 1, wherein said hydrogen emission material is held by a frame member arranged at an end of said space farthest from said evacuation hole.

* * * * *